US010090099B2

(12) United States Patent
Skinner et al.

(10) Patent No.: US 10,090,099 B2
(45) Date of Patent: Oct. 2, 2018

(54) SPARK IGNITION TRANSFORMER WITH A NON-LINEAR SECONDARY CURRENT CHARACTERISTIC

(71) Applicant: DELPHI TECHNOLOGIES IP LIMITED, St. Michael (BB)

(72) Inventors: Albert A. Skinner, Waterford, MI (US); Harry O. Levers, Jr., Clarkston, MI (US)

(73) Assignee: DELPHI TECHNOLOGIES IP LIMITED (BB)

( * ) Notice: Subject to any disclaimer, the term of this patent is extended or adjusted under 35 U.S.C. 154(b) by 410 days.

(21) Appl. No.: 14/734,374

(22) Filed: Jun. 9, 2015

(65) Prior Publication Data

US 2016/0365194 A1 Dec. 15, 2016

(51) Int. Cl.

| | |
|---|---|
| ***H01F 27/28*** | (2006.01) |
| ***H01F 17/04*** | (2006.01) |
| ***H01F 38/12*** | (2006.01) |
| ***F02P 9/00*** | (2006.01) |
| ***H01F 1/14*** | (2006.01) |
| ***H01F 27/255*** | (2006.01) |
| *F02P 3/04* | (2006.01) |

(52) U.S. Cl.

CPC ..... *H01F 38/12* (2013.01); *F02P 9/002* (2013.01); *H01F 1/14* (2013.01); *H01F 27/255* (2013.01); *F02P 3/0442* (2013.01)

(58) Field of Classification Search

USPC ..... 336/220, 216, 221, 222, 83, 192; 123/594, 634, 635

See application file for complete search history.

(56) References Cited

U.S. PATENT DOCUMENTS

| | | | | |
|---|---|---|---|---|
| 4,926,152 | A * | 5/1990 | Ito | H01F 38/12 336/198 |
| 4,990,881 | A * | 2/1991 | Ooyabu | H01F 38/12 123/634 |
| 5,349,320 | A * | 9/1994 | Suzuki | H01F 38/12 336/107 |

(Continued)

FOREIGN PATENT DOCUMENTS

| | | | |
|---|---|---|---|
| EP | 1069284 | A2 | 1/2001 |
| EP | 2639446 | A1 | 9/2013 |
| WO | 2015009594 | A1 | 1/2015 |

*Primary Examiner* — Elvin G Enad
*Assistant Examiner* — Kazi Hossain
(74) *Attorney, Agent, or Firm* — Joshua M. Haines

(57) ABSTRACT

An ignition transformer for use with a spark ignition system for an internal combustion engine includes a central core, a primary coil, a secondary coil, and a magnetic return. The central core defines a first end and a second end. The primary coil is used to vary magnetic energy into the central core in response to a primary current applied to the primary coil. The secondary coil is used to generate a secondary voltage in response to changes in the magnetic energy in the central core. The magnetic return defines a return-path to couple magnetic energy from the first end to the second end. A permeability value of the return-path is selected so the transformer has a secondary-current versus time-response characteristic that decays to fifty-percent (50%) of an initial secondary current when ten percent (10%) to twenty-five percent (25%) of a burn-time interval has passed.

6 Claims, 6 Drawing Sheets

(56) References Cited

U.S. PATENT DOCUMENTS

| | | | | |
|---|---|---|---|---|
| 5,685,065 | A * | 11/1997 | Suzuki | H01F 38/12 123/634 |
| 5,764,124 | A * | 6/1998 | Nakamichi | H01F 38/12 336/107 |
| 7,209,023 | B2 * | 4/2007 | Klocinski | H01F 38/12 336/90 |
| 8,922,314 | B2 * | 12/2014 | Kobayashi | H01F 38/12 336/110 |
| 2005/0134416 | A1 * | 6/2005 | Maekawa | H01F 38/12 336/92 |
| 2011/0304419 | A1 | 12/2011 | Dal Re et al. | |
| 2012/0176724 | A1 * | 7/2012 | Burrows | H01T 13/50 361/263 |
| 2015/0167622 | A1 * | 6/2015 | Skinner | H01F 41/04 123/634 |

* cited by examiner

SPARK IGNITION TRANSFORMER WITH A NON-LINEAR SECONDARY CURRENT CHARACTERISTIC

TECHNICAL FIELD OF INVENTION

This disclosure generally relates to an ignition transformer for an internal combustion engine, and more particularly relates to configuring the transformer so a secondary-current versus time-response characteristic is non-linear or curved to initially decay steeply and then have an extended low current decay when the transformer is tested at a predetermined secondary voltage.

BACKGROUND OF INVENTION

Modern spark ignition internal combustion engines typically benefit high initial ignition discharge energy to initiate combustion. It is also known that a long duration spark discharge enhances combustion repeatability if, for example, poor distribution of the air-fuel mixture occurs. However, extended operation at unnecessarily high discharge currents may cause undesirable spark plug electrode erosion. It has been suggested to use two ignition coils isolated with high voltage diodes to combine the two coil outputs to provide the desired high initial discharge current and lower extended discharge current to a spark-plug. However, such a dual coil system undesirably increases the cost of an ignition system.

SUMMARY OF THE INVENTION

In accordance with one embodiment, an ignition transformer for use with a spark ignition system for an internal combustion engine is provided. The transformer includes a central core, a primary coil, a secondary coil, and a magnetic return. The central core defines a first end and a second end. The primary coil is wound about the central core. The primary coil is used to vary magnetic energy into the central core in response to a primary current applied to the primary coil. The secondary coil is wound about the central core. The secondary coil is used to generate a secondary voltage in response to changes in the magnetic energy in the central core. The magnetic return defines a return-path to couple magnetic energy from the first end to the second end. A permeability value of the return-path is selected so the transformer has a secondary-current versus time-response characteristic that decays to fifty-percent (50%) of an initial secondary current when ten percent (10%) to twenty-five percent (25%) of a burn-time interval has passed.

Further features and advantages will appear more clearly on a reading of the following detailed description of the preferred embodiment, which is given by way of non-limiting example only and with reference to the accompanying drawings.

BRIEF DESCRIPTION OF DRAWINGS

The present invention will now be described, by way of example with reference to the accompanying drawings, in which.

DETAILED DESCRIPTION

Figure 1:
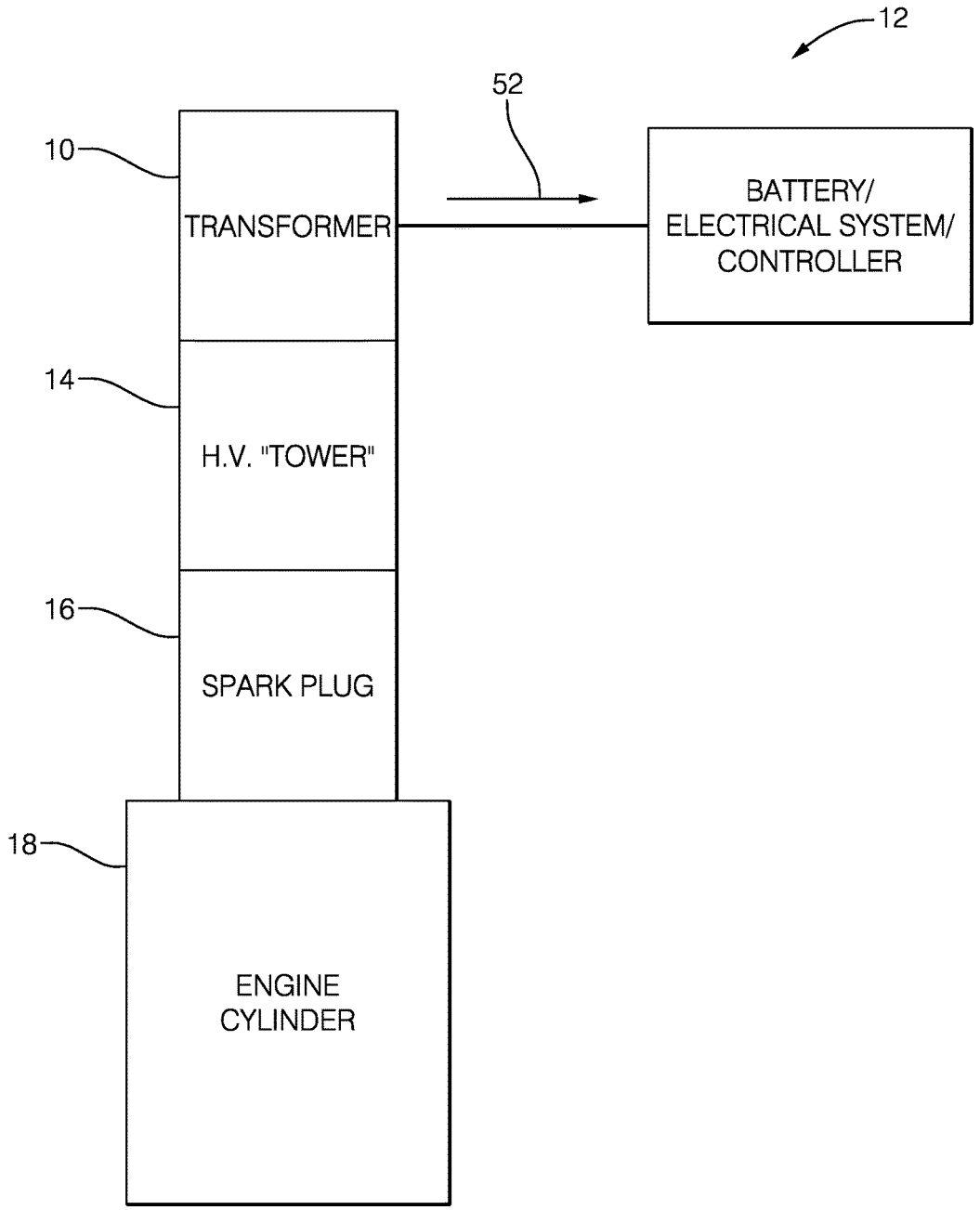
FIG. 1 is a schematic block diagram of an ignition transformer installed in a spark ignition system in accordance with one embodiment.

FIG. 1 illustrates a non-limiting example of an ignition transformer 10, hereafter the transformer 10, for use with a spark ignition system 12 for an internal combustion engine 18. As will be described in more detail below, an advantage of the transformer 10 over the prior art is that the transformer 10 provides a high initial secondary current for reliable combustion initiation, and reduced subsequent secondary current for extended spark duration. The transformer 10 advantageously accomplishes this with a single secondary coil. That is, the current and burn time an ignition system equipped with the transformer 10 described herein is comparable to the output current provided by a dual ignition coil system with two secondary coils.

The transformer 10 is coupled to a battery/electrical system/controller of a vehicle (not shown) to control a primary current 52 provided to the transformer 10, and is coupled through a so-called "high voltage tower" 14 (HV tower) to one or more spark plugs 16 to provide a combustion initiating spark inside a cylinder of the engine 18. The HV tower 14 may include, without limitation, a cup and spring arrangement.

Figure 2A:
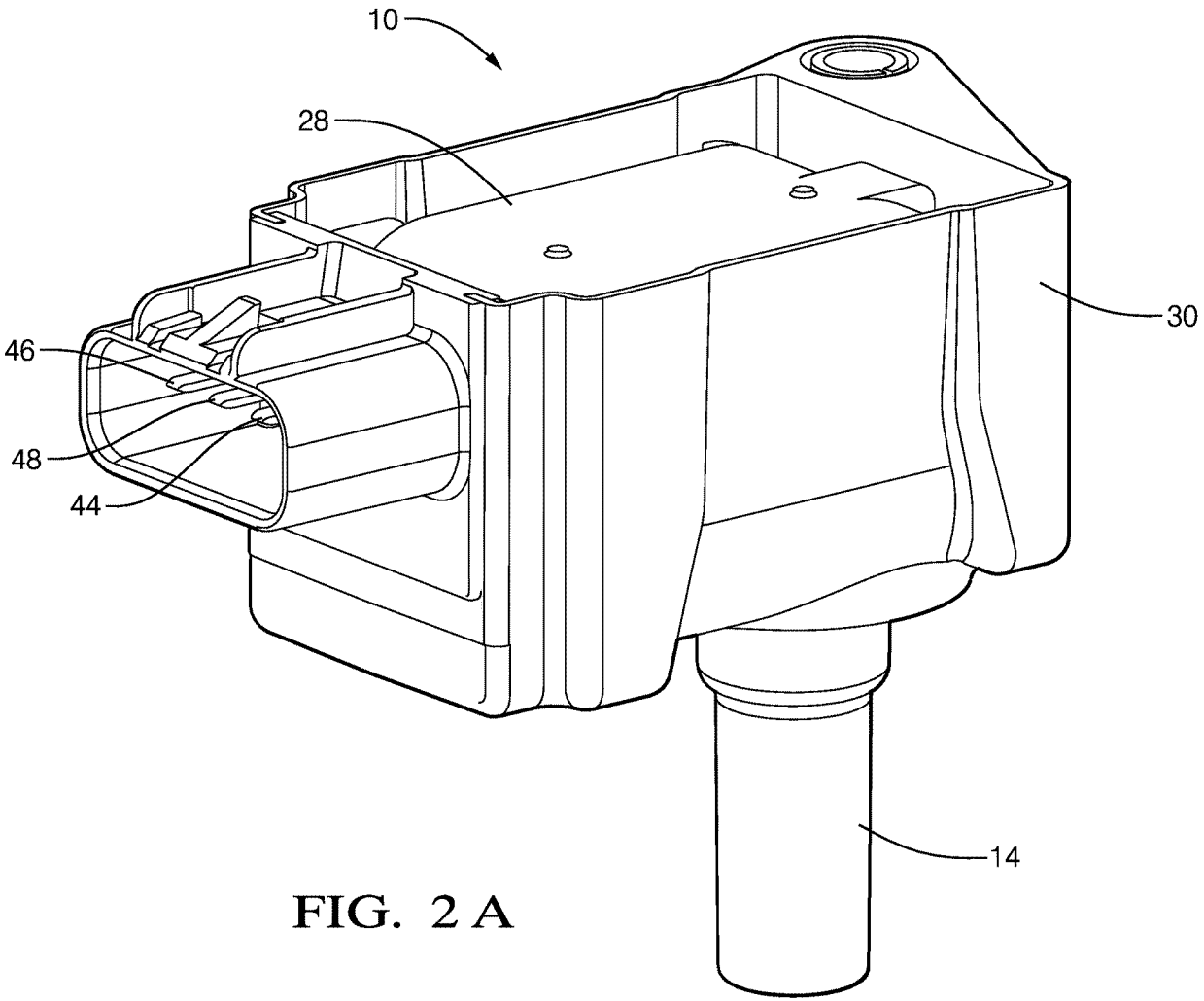
FIG. 2A is a perspective side view of the ignition transformer of FIG. 1 in accordance with one embodiment.
Figure 2B:
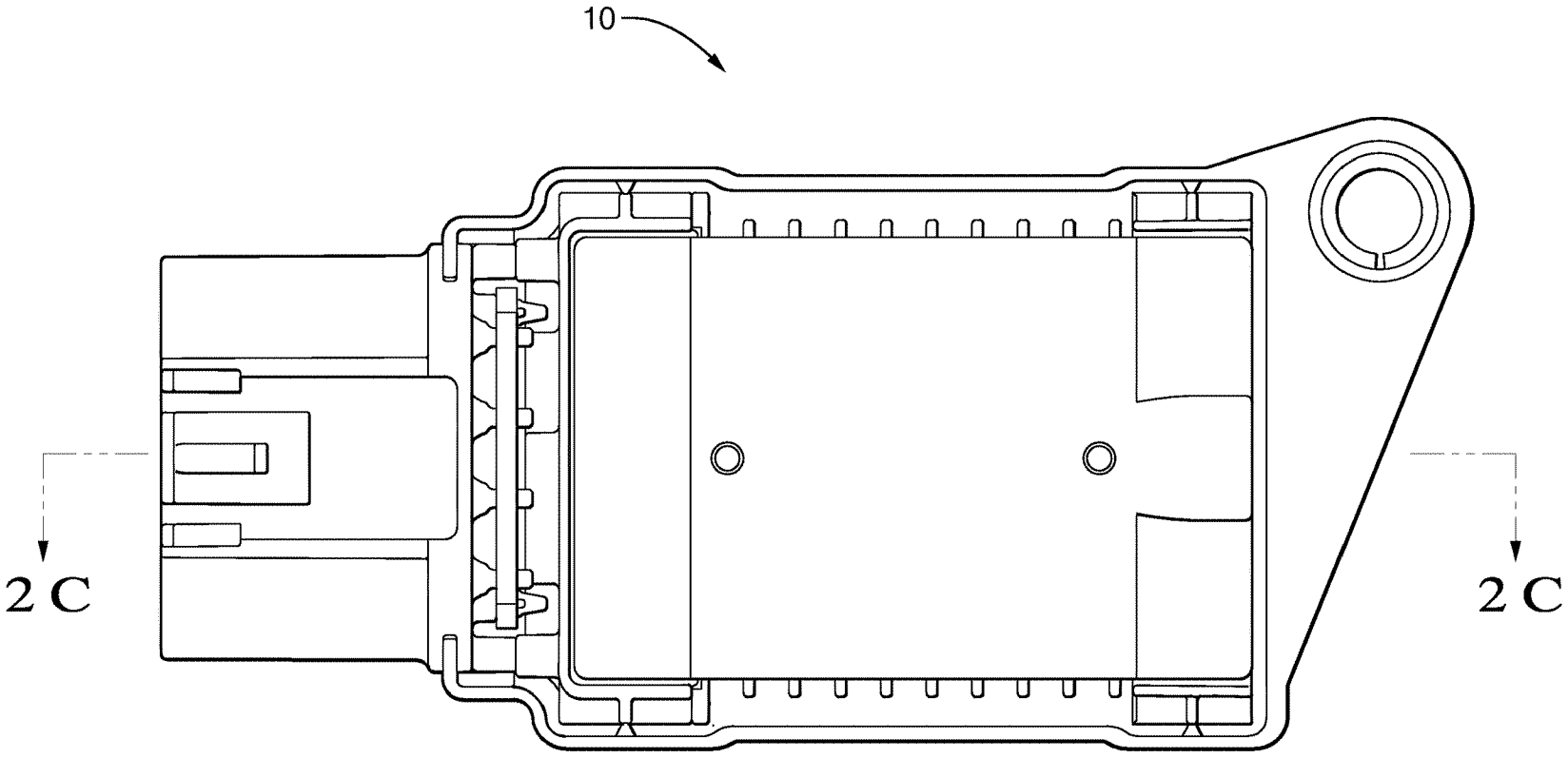
FIG. 2B is a top view of the ignition transformer of FIG. 2A in accordance with one embodiment.
Figure 2C:
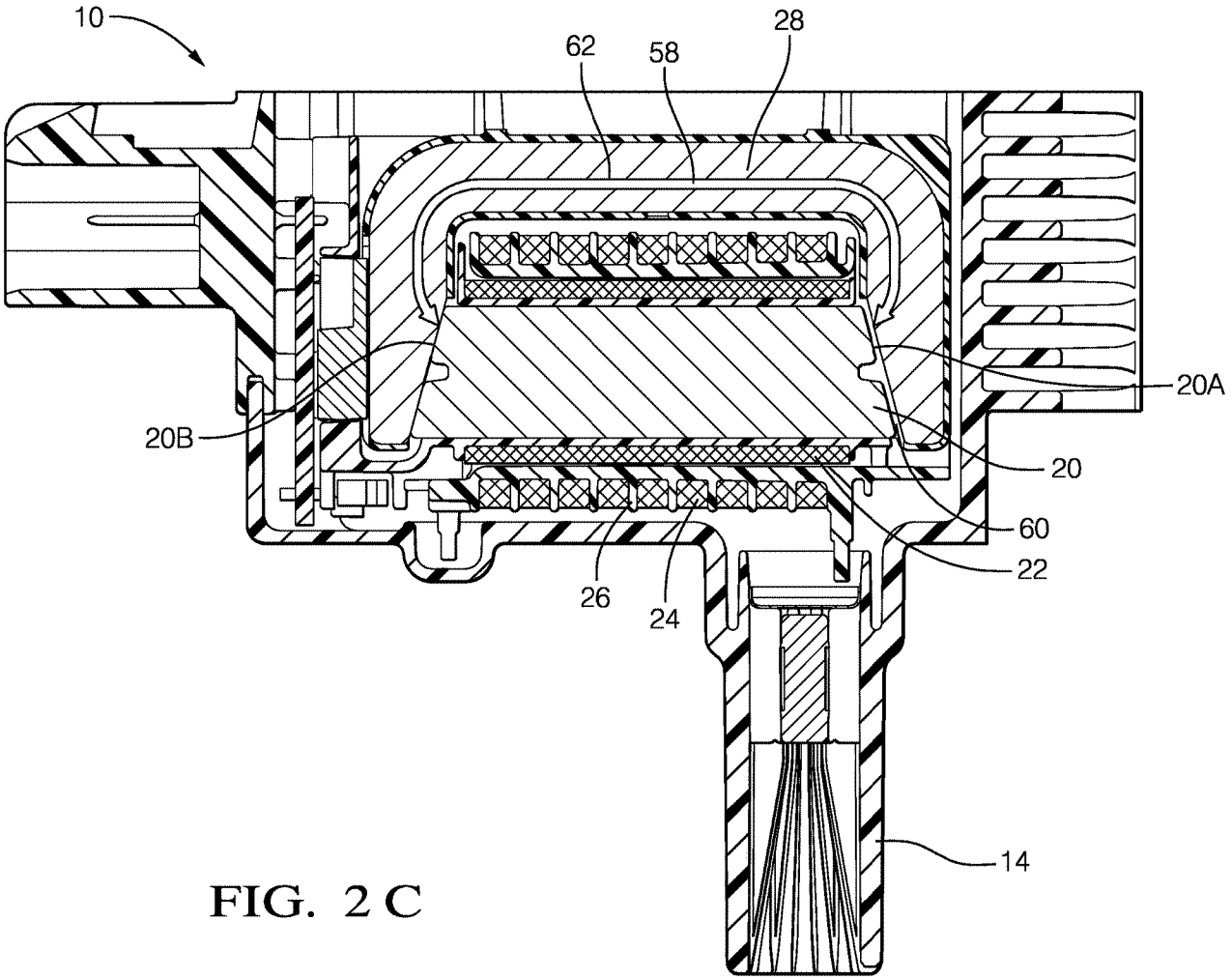
FIG. 2C is a cross section view of the ignition transformer of FIG. 2A in accordance with one embodiment.

FIGS. 2A, 2B, 2C, and 3 further illustrate details of a non-limiting example of the transformer 10. It is noted that various elements such as circuit boards, etc. which are sometimes included in ignition coils are omitted for clarity. As seen in FIGS. 2A-2C, the transformer 10 includes a central core 20, a primary coil 22 wound about the central core 20, and a secondary coil 24 wound about a hollow spool 26 that contains the central core 20 and the primary coil 22.

The central core 20 typically has a cylindrical shape and may be formed of laminated electrical steel, for example 50A800 electrical silicon steel. The transformer 10 further includes a magnetic return 28, and a case 30 configured to at least partially surround the central core 20, the primary coil 22, the secondary coil 24, and the magnetic return 28. The magnetic return 28 may advantageously be formed of a material having a relative magnetic permeability value between 10 and 1500, such as a composite iron material consisting essentially of iron particles and a dielectric binder such as an epoxy resin. The binder in the composite iron is magnetically equivalent to air and so provides the equivalent of a distributed air gap. In one non-limiting embodiment, there is no actual air gap defined between the central core 20 and the magnetic return 28.

Figure 3:
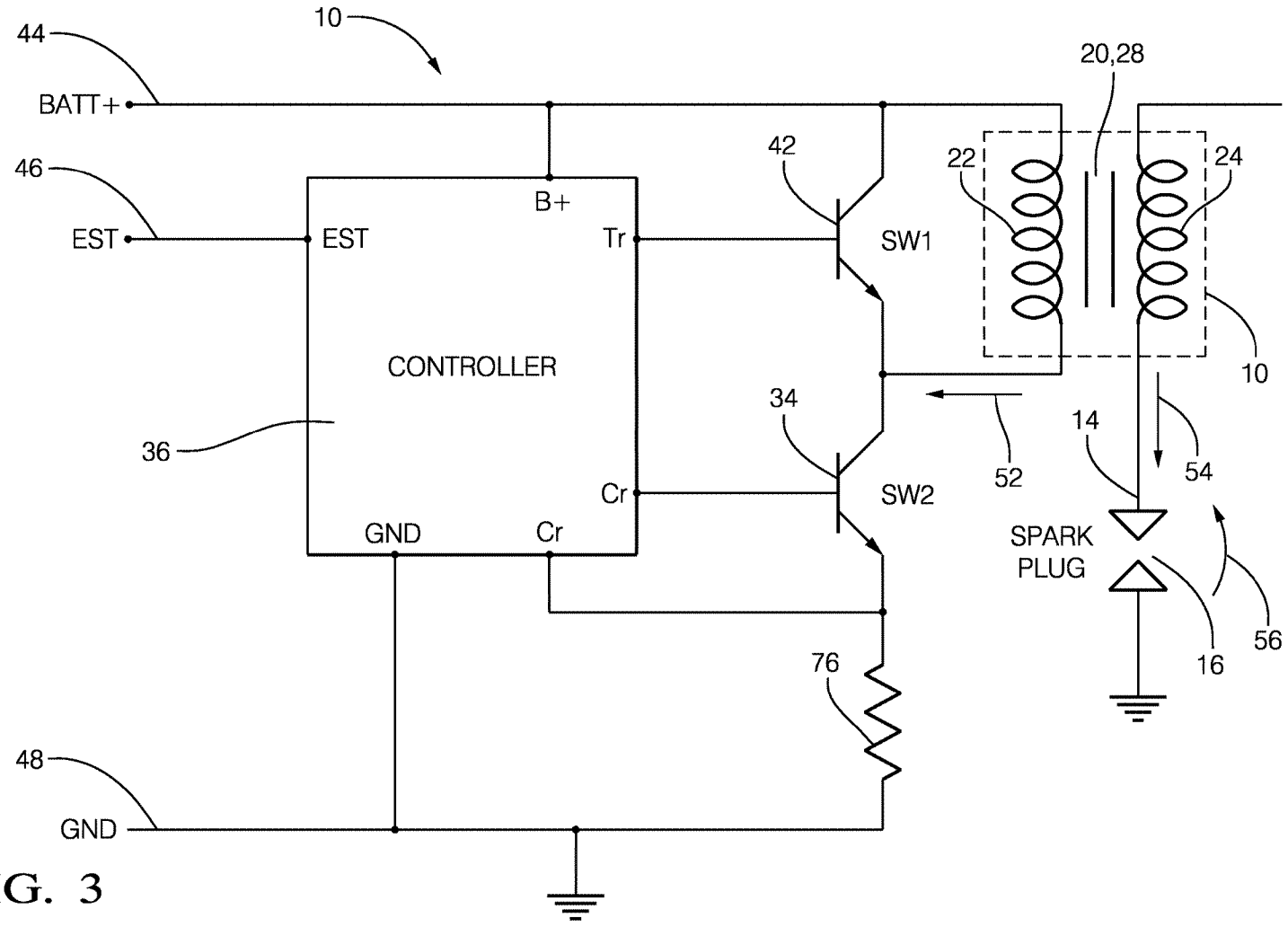
FIG. 3 is an electrical schematic diagram of the system of FIG. 1 accordance with one embodiment.

Referring now to FIG. 3, the system 12 includes a first switch 34 (e.g. an IGBT) coupled to the primary coil 22. The first switch 34 is operable to an off-state, an on-state, and optionally a linear-state to control a primary current 52 through the primary coil 22, and a secondary current 54 through the secondary coil 24. The system 12 also includes a spark-plug 16 coupled to the secondary coil 24. Those in the ignition arts will recognize that a relatively long duration spark discharge may be maintained if the secondary current 54 is sufficient to generate an adequate voltage across the gap of the spark-plug 16. That is, a spark discharge may be maintained for as long as desired given that a sufficient amount of magnetic energy is stored in the central core 20 of the transformer 10.

The system 12 includes a controller 36 configured to receive a single control-signal 46, sometimes referred to as the electronic spark timing signal or EST. In this non-limiting example the single control-signal 46 includes a spark-control portion followed by a snubbing-control portion. WIPO publication WO2015/009594 published Jan. 22, 2015 and owned by the same assignee as this application describes one way that multiple signal portions can be presented in a single signal.

Referring again to FIG. 2C, the transformer 10 includes a central core 20 that defines a first end 20A and a second end 20B. The primary coil 22 is wound about the central core 20. The primary coil 22 is used to vary magnetic energy into the central core 20 in response to a primary current 52 (FIG. 3) applied to the primary coil 22. The secondary coil 24 is also wound about the central core 20. The secondary coil 24 is used to generate a secondary voltage 56 in response to changes in the magnetic energy in the central core 20. The magnetic return 28 defines a return-path 58 to couple magnetic energy from the first end 20A to the second end 20B, or from the second end to the 20B first end 20A.

The transformer 10 describe herein is distinguished from prior examples as the central core 20 and the magnetic return 28 cooperate to establish a magnetic circuit that can be characterized as having relatively low magnetic permeability with a high range of magnetizing force over which this magnetic permeability is fairly constant. As such, when the central core 20 permeability is near "saturation", the magnetic return 28 is still in the nearly linear portion of the magnetization (BH, hysteresis) curve. By way of example and not limitation, the magnetic return may be formed of a material characterized by a relative-permeability value between 10 and 1500.

As energy is stored in the distributed air gap of the magnetic return 28, the level of magnetic flux follows the magnetization characteristics of the central core 20. Since the magnetic return 28 is operated over a fairly linear portion of the magnetization curve, the overall flux path does not substantially change as the central core 20 approaches saturation. Therefore, the magnetic coupling stays fairly constant and the output secondary current mimics the magnetization characteristics of the central core 20. The inventors have discovered that a magnetic return 28 formed of a composite iron material containing 98% iron particles and 2% binder by weight have yielded satisfactory performance for providing a linear response.

As illustrated in the schematic electrical diagram of one embodiment in FIG. 3, the primary coil 22 is electrically connected to an electrical power source, such as the vehicle electrical system or battery. The primary current 52 is controlled by a first switch 34, such as an insulated gate bipolar transistor (IGBT). The collector terminal of the IGBT is connected to the primary coil 22 and the emitter terminal is connected to ground. The first switch 34 is turned on and off by the controller 36 based on an electronic spark timing (EST), i.e. the single control-signal 46, received from an engine sensor or an electronic engine unit (ECU) which may be part of the vehicle electrical system. When the first switch 34 is in a conducive state, hereinafter referred to as "tuned on", the primary current 52 from the battery flows through the primary coil 22 to ground, thus generating a magnetic field in the central core 20 and the magnetic return 28. When the first switch 34 is in a non-conducive state, hereinafter referred to as "tuned off", the primary current 52 through the primary coil 22 stops and the magnetic field collapses, inducing a secondary current in the secondary coil 24. Because the secondary coil 24 contains many more turns than the primary coil 22, the voltage generated in the secondary coil 24 is higher than the primary coil 22. The secondary coil 24 is connected to the spark-plug 16 via the HV tower 14, and the high voltage induced in the secondary coil 24 generates a plasma bridge or spark discharge between the electrodes of the spark-plug 16.

In order to limit the duration of the spark generated by the ignition coil, the transformer 10 includes a second switching circuit 42, hereafter referred to as the second switch 42, electrically connected to each terminal of the primary coil 22. The second switch 42 may also be implemented by an IGBT, although other electrically controlled switching devices, such as bipolar junction transistors, metal oxide semiconductor field effect transistors, electromechanical relays, or the like may be used as the first switch 34 and/or the second switch 42. The second switch 42 is also controlled by the controller 36. The second switch 42 is turned off while the first switch 34 is supplying the primary current 52 to the primary coil 22 and for an initial period after the current is induced in the secondary coil 24. After the secondary current is induced in the secondary coil 24, the controller 36 may switch the second switch 42 on, thus shorting the terminals of the primary coil 22 and thereby inducing another primary current 52 in the primary coil 22. Without subscribing to any particular theory of operation, the energy transferred from the secondary coil 24 to the primary coil 22 by the inducement of the primary current 52 reduces the secondary current in the secondary coil 24 and limits the duration of the spark.

The controller 36 may be configured to control both the first switch 34 and the second switch 42 based on a single EST signal rather than a separate signal to control the first switch 34 and a separate signal to control the second switch 42, thus eliminating the need for at least one wire to the controller 36 to carry the additional signal. As shown in FIG. 3, the controller 36 only requires three inputs, BATT+input 44 connected to the battery, the single control-signal 46 carrying the EST signal and connected to the engine sensor or ECU, and GND input 48 connected to the electrical ground. Therefore, as shown in FIG. 2A, the transformer 10 only requires three electrical terminals.

The controller 36 may include a microprocessor, application specific integrated circuit (ASIC), or may be built from discrete logic and timing circuits (not shown). Software instructions that program the controller 36 to control the first switch 34 and the second switch 42 may be stored in a non-volatile (NV) memory device (not shown). The memory device may be contained within the microprocessor or ASIC or it may be a separate device. Non-limiting examples of the types of NV memory that may be used include electrically erasable programmable read only memory (EEPROM), masked read only memory (ROM) and flash memory. The controller 36 may also include analog to digital (A/D) convertor circuits and digital to analog (D/A) convertor circuits (not shown) to allow the controller 36 to establish electrical communication with other electronic devices, such as the ECU. The controller 36 may be integral to the transformer 10, or may be located remotely from the transformer 10.

Figure 4:
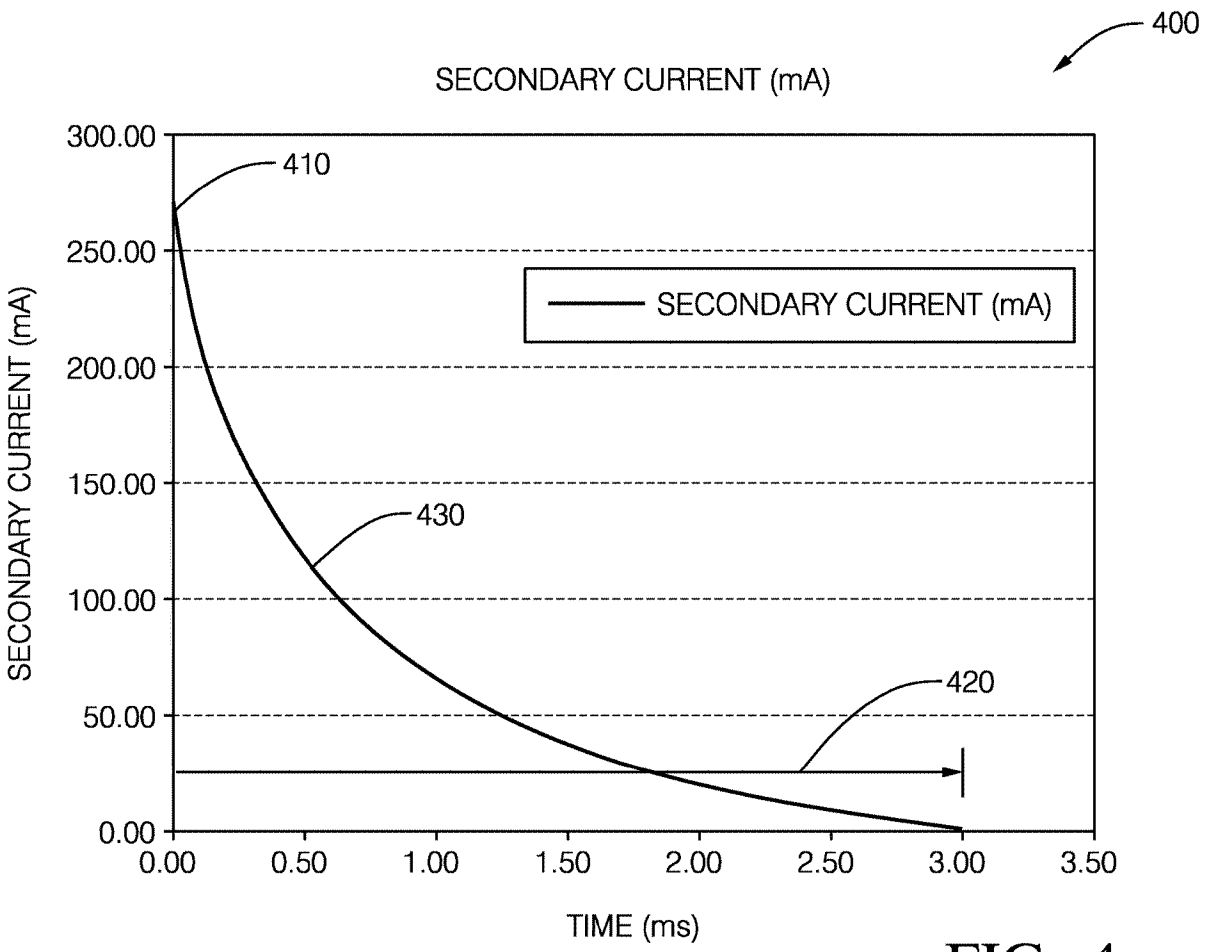
FIG. 4 is a signal timing diagram of an electronic spark timing signal in relation to the conductive states of a first and second switching circuit and a primary coil current in accordance with one embodiment.

FIG. 4 illustrates data from a non-limiting example of the transformer 10 when subjected to a test procedure established by the Society of Automotive Engineers (SAE); test procedure J973. During the test, the secondary voltage is held or clamped at one-thousand Volts (1000V), and the secondary current 54 is monitored. This method of testing was adopted as the spark gap itself is not repeatable and the goal was to get a repeatable method to "simulate" the electrical load presented by the spark gap.

The test results of prior examples of ignition transformers are a relatively straight line. However, the transformer 10 described herein is unique in that a permeability value of the return-path 58 and/or the magnetic path through the central core 20 is selected such that the transformer 10 has a secondary-current versus time-response characteristic 400 that decays to fifty-percent (50%) of an initial secondary current 410 when ten percent (10%) to twenty-five percent (25%) of a burn-time interval 420 has passed. The burn-time interval 420 occurs or is defined while the secondary voltage is 1000 volts. The specific part tested for the data shown in FIG. 4 had an initial secondary current value of 266 mA. The 50% current value 430 is then 133 mA, which occurs at about 0.4 ms. The burn-time interval is 3 ms, so the transformer tested is characterized by a 50% current value 430 of about (0.4/3)*100%=13% of the burn-time interval 420.

An alternative way to characterize the non-linear characteristic of the secondary-current versus time-response characteristic 400 is to compare the slope of the curve at two points, at a 75% of peak current value and a 25% of peak current value. The data used for FIG. 4 has the 75% of peak current value of 200 mA at 0.14 ms where the slope is about −385 A/s, and the 25% of peak current value of 0.67 mA at 1.12 ms where the slope is about −61 A/s. A comparison may be made by determining a ratio of the two slopes which equals about 6.3. A suitable range of such a slope-ratio may be 3 to 20.

As mentioned above, the transformer 10 can be configured to provide a performance characteristic (the secondary-current versus time-response characteristic 400) similar to that shown in FIG. 4 if the magnetic return 28 is formed of a material characterized by a relative-permeability value between 10 and 1500. Suitable materials include, but are not limited to, injection moldable polymers filled with 30 to 60% by volume iron, which has a relative permeability in the range of 10 to 100 and would delay the 50% current value 430 when compared to FIG. 4. Alternatively, more densified compression molded irons with a relative permeability in the range of 500 to 1500 could be used to cause the 50% current value 430 to occur earlier when compared to FIG. 4.

Referring again to FIG. 2C, an alternative embodiment of the transformer 10 includes an air-gap 60 between the first end 20A and a corresponding end of the magnetic return 28, and may use a laminated steel to form the magnetic return 28. By way of example and not limitation, when an air-gap 60 is present the magnetic return 62 may be made of materials with a relative permeability range of 500 to 1500 or out of similar or the same as the core material with a permeability >1500. The air-gap 60 is preferably sized so the core saturates at a current lower than the peak current of the transformer 10. By comparison, most typical ignition coils have a ratio of core area ($mm^2$) to gap-size (mm) of 50 mm to 200 mm, while the transformer 10 describe herein preferably has a ratio in the range of 250 mm to 1500 mm.

The B-H curve of the material used for the central core 20 is critical so that it does not have a sharp knee, as this would yield a very sudden relative 50% current value 430 so very little spark initiation energy is delivered to the spark plug before the secondary current becomes relatively low. The purposeful use of materials with "softer knees" (such as low grade silicon steel, low carbon steels, 400-series stainless steels, or even pure iron) to yield the desirable non-linear secondary-current versus time-response characteristic 400, with a very useable portion of operation "above" the knee is desirable.

Accordingly, an ignition transformer (the transformer 10) is provided. By properly selecting the materials and design of the transformer 10, a performance characteristic similar to that shown in FIG. 4 can be provided while using only a single instance of the secondary coil 24.

While this invention has been described in terms of the preferred embodiments thereof, it is not intended to be so limited, but rather only to the extent set forth in the claims that follow.

We claim:

1. An ignition transformer for use with a spark ignition system for an internal combustion engine, said transformer comprising:

a central core that defines a first end and a second end;

a primary coil wound about the central core, wherein the primary coil is used to vary magnetic energy into the central core in response to a primary current applied to the primary coil;

a secondary coil wound about the central core, wherein the secondary coil is used to generate a secondary voltage in response to changes in the magnetic energy in the central core; and a magnetic return that defines a return-path to couple magnetic energy from the first end to the second end, wherein a permeability value of the return-path is selected so the transformer has a secondary-current versus time-response characteristic that decays to fifty-percent (50%) of an initial secondary current when ten percent (10%) to twenty-five percent (25%) of a burn-time interval has passed.

2. The transformer in accordance with claim 1, wherein the burn-time time interval occurs while the secondary voltage is 1000 volts.

3. The transformer in accordance with claim 1, wherein the magnetic return is formed of a material characterized by a relative-permeability value between 10 and 1500.

4. The transformer in accordance with claim 3, wherein the material comprises iron.

5. The transformer in accordance with claim 1, wherein the return-path includes an air-gap.

6. The transformer in accordance with claim 5, wherein a core area to air-gap size ratio is between 250 and 1500 mm.

* * * * *